US012790105B2

(12) United States Patent
Fornell et al.

(10) Patent No.: US 12,790,105 B2
(45) Date of Patent: Nov. 10, 2026

(54) APPARATUS FOR SUPPORTING A SPOOL OF GLASS AND METHOD FOR USING THE APPARATUS IN COMBINATION WITH A CLEAN ROOM

(71) Applicant: CORNING INCORPORATED, Corning, NY (US)

(72) Inventors: Nils Paul Fornell, Harrodsburg, KY (US); Keith Mitchell Hill, Horseheads, NY (US); Richard Curwood Peterson, Elmira Heights, NY (US)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 19/102,654

(22) PCT Filed: Aug. 28, 2023

(86) PCT No.: PCT/US2023/031224

§ 371 (c)(1),
(2) Date: Feb. 10, 2025

(87) PCT Pub. No.: WO2024/049729

PCT Pub. Date: Mar. 7, 2024

(65) Prior Publication Data

US 2026/0054915 A1 Feb. 26, 2026

Related U.S. Application Data

(60) Provisional application No. 63/374,417, filed on Sep. 2, 2022.

(51) Int. Cl.
*B65D 85/672* (2006.01)
*B65B 5/04* (2006.01)
(Continued)

(52) U.S. Cl.
CPC ..... *B65D 85/672* (2013.01); *B65B 5/04* (2013.01); *B65B 7/26* (2013.01); *B65B 23/00* (2013.01); *B65D 85/66* (2013.01)

(58) Field of Classification Search
CPC ..... B65D 85/672; B65B 5/04; B65B 7/26; B65B 23/00; B65B 23/22; B65B 31/00
See application file for complete search history.

(56) References Cited

U.S. PATENT DOCUMENTS 4,570,794 A * 2/1986 Capitao, Jr. ..... B65D 85/672 206/407
5,451,131 A 9/1995 Hecht et al.
(Continued)

FOREIGN PATENT DOCUMENTS

CN 114102330 A 3/2022
CN 112119022 B 6/2022
(Continued)

OTHER PUBLICATIONS

Translation of DE 102011081172 A1 (Year: 2013).*
Translation of WO-2013011928-A1 (Year: 2013).*

*Primary Examiner* — Thomas M Wittenschlaeger
(74) *Attorney, Agent, or Firm* — Matthew J. Mason

(57) ABSTRACT

A glass support apparatus (203) includes a frame including a plurality of walls defining an interior space extending along a frame axis. The glass support apparatus includes a first surface (227) positioned within the interior space and a second surface (229) positioned within the interior space and spaced apart from the first surface. The first surface and the second surface are non-parallel and converging. The glass support apparatus includes a closure (213) attached to one or more of the plurality of walls. The closure moves between an opened position, in which the interior space is in fluid
(Continued)

communication with an exterior of the frame, and a closed position. Methods of porting a spool of glass are provided.

15 Claims, 10 Drawing Sheets

(51) Int. Cl.

| | |
|---|---|
| ***B65B 7/26*** | (2006.01) |
| ***B65B 23/00*** | (2006.01) |
| ***B65D 85/66*** | (2006.01) |

(56) References Cited

U.S. PATENT DOCUMENTS

| | | | | |
|---|---|---|---|---|
| 5,823,343 | A | 10/1998 | Heffernan | |
| 5,970,271 | A | 10/1999 | Clough | |
| 6,679,672 | B1 * | 1/2004 | Barrows | H10P 72/3216 414/217 |
| 6,771,355 | B2 | 8/2004 | Ishii et al. | |
| 7,445,415 | B2 | 11/2008 | Bonora et al. | |
| 7,568,875 | B2 | 8/2009 | Le Guet et al. | |
| 2014/0284236 | A1 | 9/2014 | Kuebart et al. | |
| 2019/0322436 | A1 | 10/2019 | Bigelow et al. | |
| 2024/0002272 | A1 | 1/2024 | Brown et al. | |

FOREIGN PATENT DOCUMENTS

| | | | | |
|---|---|---|---|---|
| DE | 9113312 | U1 | 1/1992 | |
| DE | 102011081172 | A1 * | 2/2013 | B65D 85/48 |
| EP | 2744719 | B1 | 5/2015 | |
| JP | 59-043380 | U | 3/1984 | |
| WO | WO-2013011928 | A1 * | 1/2013 | B65H 75/241 |
| WO | 2015/018655 | A1 | 2/2015 | |
| WO | 2019/220997 | A1 | 11/2019 | |

* cited by examiner

APPARATUS FOR SUPPORTING A SPOOL OF GLASS AND METHOD FOR USING THE APPARATUS IN COMBINATION WITH A CLEAN ROOM

CROSS-REFERENCE TO RELATED APPLICATIONS

This is a national stage application under 35 U.S.C. § 371 of International Application No. PCT/US2023/031224, filed on Aug. 28, 2023, which claims the benefit of priority under 35 U.S.C. § 119 of U.S. Provisional Application Ser. No. 63/374,417 filed on Sep. 2, 2022, the content of which is relied upon and incorporated herein by reference in their entireties.

FIELD

The present disclosure relates generally to methods for supporting a spool of glass and, more particularly, to methods for supporting a spool of glass with a glass support apparatus comprising a frame.

BACKGROUND

It is known to manufacture molten material into a glass ribbon with a glass manufacturing apparatus. The glass ribbon can be stored by winding the glass ribbon into a roll with a winding apparatus. However, storing a spool of glass in a clean environment can be expensive and time-consuming. Further, transporting the spool of glass can risk damage and/or contamination to the spool of glass.

SUMMARY

The following presents a simplified summary of the disclosure to provide a basic understanding of some aspects described in the detailed description.

In aspects, a glass support apparatus can comprise a frame comprising a plurality of walls defining an interior. The interior is sized and shaped to receive one or more spools of glass. The glass support apparatus can comprise a plurality of tapered surfaces that can support the one or more spools of glass. The glass support apparatus can comprise a closure that can move between an opened position and a closed position. In the opened position, the one or more spools of glass can be inserted into or removed from the interior. In the closed position, the closure can form a seal with the frame of the glass support apparatus, thus limiting airborne particulates from entering the interior. In this way, the one or more spools of glass can be protected within the interior.

In aspects, a glass support apparatus comprises a frame comprising a plurality of walls defining an interior space extending along a frame axis. The glass support apparatus comprises a first surface positioned within the interior space. The glass support apparatus comprises a second surface positioned within the interior space and spaced apart from the first surface. The first surface and the second surface are non-parallel and converging. The glass support apparatus comprises a closure attached to one or more of the plurality of walls. The closure is configured to move between an opened position, in which the interior space is in fluid communication with a space exterior of the frame, and a closed position.

In aspects, a first wall of the plurality of walls comprises a first engagement feature and a second wall of the plurality of walls, opposite the first wall, comprises a second engagement feature.

In aspects, the first engagement feature comprises a recess and the second engagement feature comprises a protrusion.

In aspects, a spacer is positioned within the interior space in contact with an inner surface of the closure. The spacer comprises an elastically deformable material.

In aspects, a shaft is positioned within the interior space and extends substantially parallel to the frame axis. A first end of the shaft is attached to the closure and an opposing second end of the shaft is attached to an end wall of the plurality of walls opposite the closure.

In aspects, a third surface is positioned within the interior space and extends parallel to the first surface. The second surface is positioned between the first surface and the third surface.

In aspects, a fourth surface is positioned within the interior space and spaced apart from the third surface. The fourth surface extends parallel to the second surface with the third surface positioned between the second surface and the fourth surface.

In aspects, a glass support apparatus comprises a frame comprising a plurality of walls defining an interior space extending along a frame axis. The glass support apparatus comprises a first surface positioned within the interior space. The glass support apparatus comprises a second surface positioned within the interior space and spaced apart from the first surface. The first surface and the second surface are non-parallel and converging. The frame is configured to receive a spool of glass supported within the interior space by the first surface and the second surface. The glass support apparatus comprises a closure attached to one or more of the plurality of walls. The closure is configured to move between an opened position, in which the interior space is in fluid communication with a space exterior of the frame, and a closed position, in which the closure and the plurality of walls form an airtight seal.

In aspects, a first wall of the plurality of walls comprises a first engagement feature and a second wall of the plurality of walls, opposite the first wall, comprises a second engagement feature.

In aspects, the first engagement feature comprises a recess and the second engagement feature comprises a protrusion.

In aspects, a spacer is positioned within the interior space in contact with an inner surface of the closure. The spacer comprises an elastically deformable material positioned between the spool of glass and the closure.

In aspects, a shaft is positioned within the interior space and extends substantially parallel to the frame axis. A first end of the shaft is attached to the closure and an opposing second end of the shaft is attached to an end wall of the plurality of walls opposite the closure. The shaft extends through a center of the spool of glass.

In aspects, the frame is configured to receive a second spool of glass supported within the interior space by the first surface and the second surface. The second spool of glass is spaced apart from the spool of glass.

In aspects, a third surface is positioned within the interior space and extends parallel to the first surface. The second surface is positioned between the first surface and the third surface.

In aspects, a fourth surface is positioned within the interior space and spaced apart from the third surface. The fourth surface extends parallel to the second surface with the third surface positioned between the second surface and the fourth surface.

In aspects, methods of supporting a spool of glass are provided. Methods comprise positioning a frame comprising an interior space against a wall comprising an opening such that the interior space is in fluid communication with the opening and the frame forms a seal with the wall. Methods comprise delivering the spool of glass from a clean room environment through the opening and into the interior space of the frame. Methods comprise sealing the interior space using a closure.

In aspects, methods comprise exposing the spool of glass to the clean room environment prior to positioning the frame against the wall and as the spool of glass is delivered through the opening.

In aspects, delivering the spool of glass comprises delivering a second spool of glass from the clean room environment through the opening and into the interior space such that the spool of glass and the second spool of glass are arranged in an end-to-end configuration within the interior space.

In aspects, methods comprise positioning a shaft within the interior space extending through a center of the spool of glass and the second spool of glass.

In aspects, methods comprise positioning one or more spacers at ends of the spool of glass, the one or more spacers comprising an elastically deformable material.

Additional features and advantages of the aspects disclosed herein will be set forth in the detailed description that follows, and in part will be clear to those skilled in the art from that description or recognized by practicing the aspects described herein, including the detailed description which follows, the claims, as well as the appended drawings. It is to be understood that both the foregoing general description and the following detailed description present aspects intended to provide an overview or framework for understanding the nature and character of the aspects disclosed herein. The accompanying drawings are included to provide further understanding and are incorporated into and constitute a part of this specification. The drawings illustrate various aspects of the disclosure, and together with the description explain the principles and operations thereof.

BRIEF DESCRIPTION OF THE DRAWINGS

These and other features, aspects and advantages are better understood when the following detailed description is read with reference to the accompanying drawings, in which.

DETAILED DESCRIPTION

Figure 1:
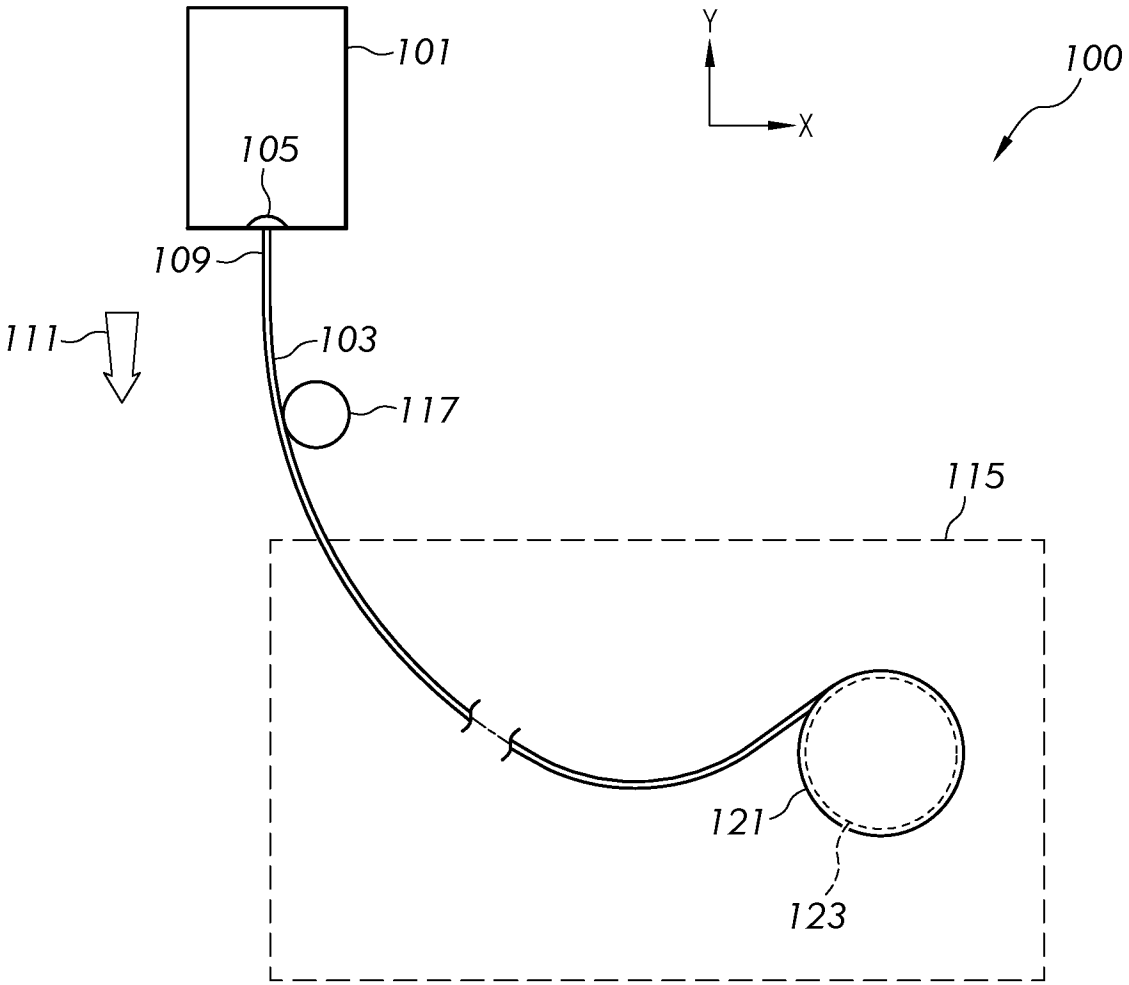
FIG. 1 schematically illustrates example aspects of a glass manufacturing apparatus in accordance with aspects of the disclosure.

Aspects will now be described more fully hereinafter with reference to the accompanying drawings in which example aspects are shown. Whenever possible, the same reference numerals are used throughout the drawings to refer to the same or like parts. However, this disclosure may be embodied in many different forms and should not be construed as limited to the aspects set forth herein.

As used herein, the term "about" means that amounts, sizes, formulations, parameters, and other quantities and characteristics are not, and need not be, exact, but may be approximate and/or larger or smaller, as desired, reflecting tolerances, conversion factors, rounding off, measurement error and the like, and other factors known to those of skill in the art.

Ranges can be expressed herein as from "about" one value, and/or to "about" another value. When such a range is expressed, another aspect includes from the one value to the other value. Similarly, when values are expressed as approximations by use of the antecedent "about," it will be understood that the value forms another aspects. It will be further understood that the endpoints of each of the ranges are significant both in relation to the other endpoint, and independently of the other endpoint.

Directional terms as used herein—for example up, down, right, left, front, back, top, bottom, upper, lower, etc.—are made only with reference to the figures as drawn and are not intended to imply absolute orientation.

Unless otherwise expressly stated, it is in no way intended that any methods set forth herein be construed as requiring that its steps be performed in a specific order, nor that with any apparatus, specific orientations be required. Accordingly, where a method claim does not actually recite an order to be followed by its steps, or that any apparatus claim does not actually recite an order or orientation to individual components, or it is not otherwise specifically stated in the claims or description that the steps are to be limited to a specific order, or that a specific order or orientation to components of an apparatus is not recited, it is in no way intended that an order or orientation be inferred in any respect. This holds for any possible non-express basis for interpretation, including: matters of logic with respect to arrangement of steps, operational flow, order of components, or orientation of components; plain meaning derived from grammatical organization or punctuation, and; the number or type of aspects described in the specification.

As used herein, the singular forms "a," "an" and "the" include plural references unless the context clearly dictates otherwise. Thus, for example, reference to "a" component includes aspects having two or more such components, unless the context clearly indicates otherwise.

The word "exemplary," "example," or various forms thereof are used herein to mean serving as an example, instance, or illustration. Any aspect or design described herein as "exemplary" or as an "example" should not be construed as preferred or advantageous over other aspects or designs. Furthermore, examples are provided solely for purposes of clarity and understanding and are not meant to limit or restrict the disclosed subject matter or relevant portions of this disclosure in any manner. It can be appreciated that a myriad of additional or alternate examples of varying scope could have been presented but have been omitted for purposes of brevity.

As used herein, the terms "comprising" and "including", and variations thereof, shall be construed as synonymous and open-ended, unless otherwise indicated. A list of elements following the transitional phrases comprising or including is a non-exclusive list, such that elements in addition to those specifically recited in the list may also be present.

The terms "substantial," "substantially," and variations thereof as used herein are intended to represent that a described feature is equal or approximately equal to a value or description. For example, a "substantially planar" surface is intended to denote a surface that is planar or approximately planar. Moreover, "substantially" is intended to denote that two values are equal or approximately equal. In aspects, "substantially" may denote values within about 10% of each other, such as within about 5% of each other, or within about 2% of each other.

Modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first end and a second end generally correspond to end A and end B or two different or two identical ends or the same end.

The present disclosure relates to a glass support apparatus and methods for supporting a spool of glass. For purposes of this application, "glass ribbon" may be considered one or more of a glass ribbon in a viscous state, a glass ribbon in an elastic state (e.g., at room temperature) and/or a glass ribbon in a viscoelastic state between the viscous state and the elastic state. Methods and apparatus for supporting a spool of glass will now be described by way of example aspects. For purposes of the disclosure, in aspects, a glass manufacturing apparatus can comprise a glass forming apparatus that forms a glass article (e.g., a glass ribbon) from a quantity of molten material. In aspects, the glass ribbon can be employed in a variety of display applications comprising, but not limited to, liquid crystal displays (LCDs), electrophoretic displays (EPD), organic light emitting diode displays (OLEDs), plasma display panels (PDPs), touch sensors, photovoltaics, foldable phones, etc.

As schematically illustrated in FIG. 1, in aspects, an exemplary glass manufacturing apparatus 100 can comprise a forming apparatus 101 configured to form a glass ribbon 103. In aspects, the forming apparatus 101 can comprise a slot draw apparatus, float bath apparatus, down-draw apparatus, up-draw apparatus, press-rolling apparatus, or other glass forming apparatus that forms a glass ribbon. In aspects, the forming apparatus 101 can comprise a delivery conduit through which the glass ribbon 103 can exit the forming apparatus 101. For example, the delivery conduit can comprise a passageway with an opening 105. The delivery conduit can be oriented along a direction of gravity, such that the glass ribbon 103 can flow downwardly along the direction of gravity through the delivery conduit.

In aspects, the forming apparatus 101 can define an upstream portion of a travel path 109 extending in a travel direction 111. The forming apparatus 101 can convey the glass ribbon 103 along the upstream portion of the travel path 109 in the first travel direction 111. In aspects, the forming apparatus 101 can be positioned at an exterior of a clean room environment 115, with one or more portions of the glass manufacturing apparatus 100 positioned within the clean room environment 115. The clean room environment 115 can be contained within one or more walls (e.g., illustrated with dashed lines in FIG. 1) and may comprise a reduced level of particulates (e.g., dust, airborne organisms, vaporized particles, etc.) as compared to a level of particulates at an exterior of the clean room environment 115. In aspects, the clean room environment 115 may be maintained at a positive pressure relative to an exterior of the clean room environment 115 such that air may flow from the clean room environment 115 to an environment exterior to the clean room environment 115. In aspects, a pressure differential between the clean room environment 115 and the exterior environment may be about 5 pascals or more. In aspects, the clean room environment 115 can comprise an ISO ("International Organization for Standardization") 6 clean room.

The glass ribbon 103 can enter the clean room environment 115 through an opening, for example, in a ceiling of the clean room environment 115. As the glass ribbon 103 enters the clean room environment 115, the glass ribbon 103 can be directed by a support roller 117 along a travel path toward a winding apparatus 121, whereupon the ribbon 103 can be wound into a roll. The winding apparatus 121 can comprise, for example, a spool 123 that may comprise a substantially circular cross-sectional shape. The spool 123 can receive the ribbon 103, whereupon the ribbon 103 can be wound around the spool 123 and into a roll.

Figure 2:
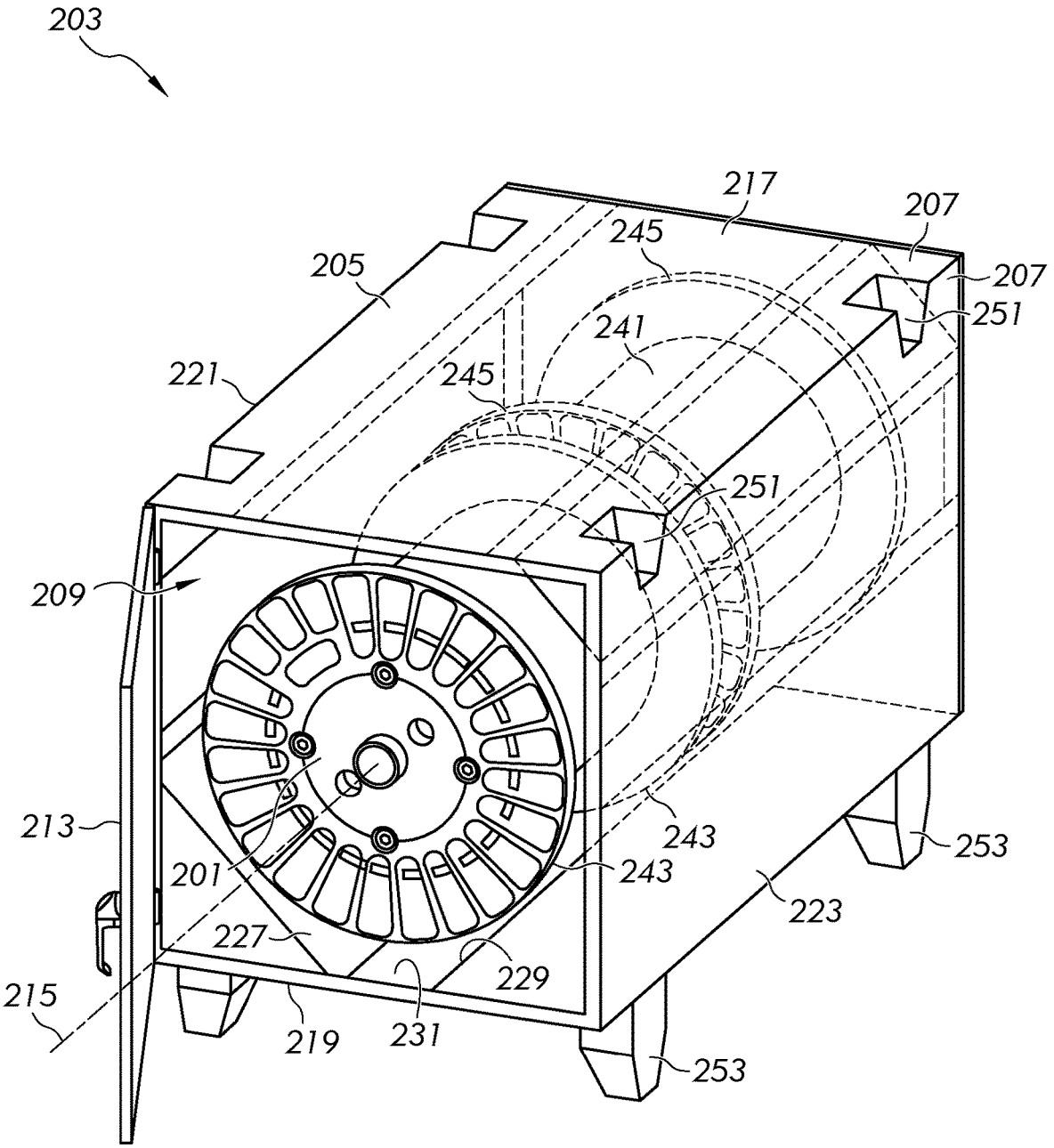
FIG. 2 illustrates a perspective view of a glass support apparatus in accordance with aspects of the disclosure.

Referring to FIG. 2, the ribbon 103 can be wound to form a first spool of glass 201 that can be received within a glass support apparatus 203. The glass support apparatus 203 can receive and store the first spool of glass 201, thus shielding the first spool of glass 201 from exposure to an ambient environment. The glass support apparatus 203 can be transported by a mode of transport through air, water, and/or land from an origin to a destination. The glass support apparatus 203 can protect the first spool of glass 201 during transport and limit the likelihood of damage to the first spool of glass 201.

The glass support apparatus 203 can comprise a frame 205 comprising a plurality of walls 207 defining an interior space 209. In aspects, the plurality of walls 207 can comprise a rigid material that is resistant to deformation or damage, for example, a stainless-steel material. The interior space 209 of the frame 205 may be substantially hollow and sized to receive one or more spools of glass. The plurality of walls 207 may be substantially closed and continuous without openings. In aspects, the glass support apparatus 203 can comprise a closure 213 (e.g., a door) attached to one or more of the plurality of walls 207. The closure 213 can be moved between an opened position, in which the interior space 209 may be in fluid communication with a space exterior of the frame 205, and a closed position, in which the closure 213 and the plurality of walls 207 can form an airtight seal. For example, in the opened position, one or more spools of glass can be moved into and/or removed from the interior space 209. In the closed position, the airtight seal is formed between the closure 213 and the plurality of walls 207, such that air, gas, particulates, etc. may not flow between the interior space 209 and the exterior of the frame 205 (e.g., from the interior space 209 to the exterior or from the exterior to the interior space 209). The closure 213 can be attached to the plurality of walls 207 in several ways, for example, by a hinge such that the closure 213 can pivot between the opened position and the closed position.

The frame 205, for example, the interior space 209, can extend along a frame axis 215, with the interior space 209 forming, for example, a substantially quadrilateral cross-sectional shape, though, varying shapes (e.g., circular shapes, square shapes, rectangular shapes, etc.) are possible. In aspects, the plurality of walls 207 can comprise a first wall 217, a second wall 219, a third wall 221, and a fourth wall 223. The first wall 217 can be opposite and parallel to the second wall 219, and the third wall 221 can be opposite and parallel to the fourth wall 223. The first wall 217 can extend between and be attached to the third wall 221 and the fourth wall 223, while the second wall 219 can extend between and be attached to the third wall 221 and the fourth wall 223. In aspects, the first wall 217 can define a top (e.g., or top wall) of the frame 205, and the second wall 219 can define a bottom (e.g., or bottom wall) of the frame 205. The frame axis 215 can intersect the closure 213 (e.g., when the closure 213 is in the closed position) and a wall opposite the closure 213, while not intersecting the first wall 217, second wall 219, third wall 221, or the fourth wall 223. For example, the frame axis 215 may be substantially perpendicular to the closure 213 when the closure 213 is in the closed position and substantially perpendicular to a wall opposite the closure 213.

The glass support apparatus 203 can comprise a first surface 227 and a second surface 229 positioned within the interior space 209. In aspects, the first surface 227 and the second surface 229 can be spaced apart, for example, with the first surface 227 and the second surface 229 non-parallel and converging in a direction away from the frame axis 215. In aspects, the first surface 227 and the second surface 229 may be substantially planar. The first surface 227 can extend between and be attached to the third wall 221 and the second wall 219, and the second surface 229 can extend between and be attached to the fourth wall 223 and the second wall 219. In aspects, the first surface 227 can be positioned as a mirror image of the second surface 229, with a base surface 231 extending between the first surface 227 and the second surface 229. The second wall 219 can comprise the base surface 231, such that the first surface 227 may be spaced apart and not in contact with the second surface 229. In aspects, the width of the base surface 231 (e.g., distance between the first surface 227 and the second surface 229) may be substantially constant along the frame axis 215.

Figure 3:
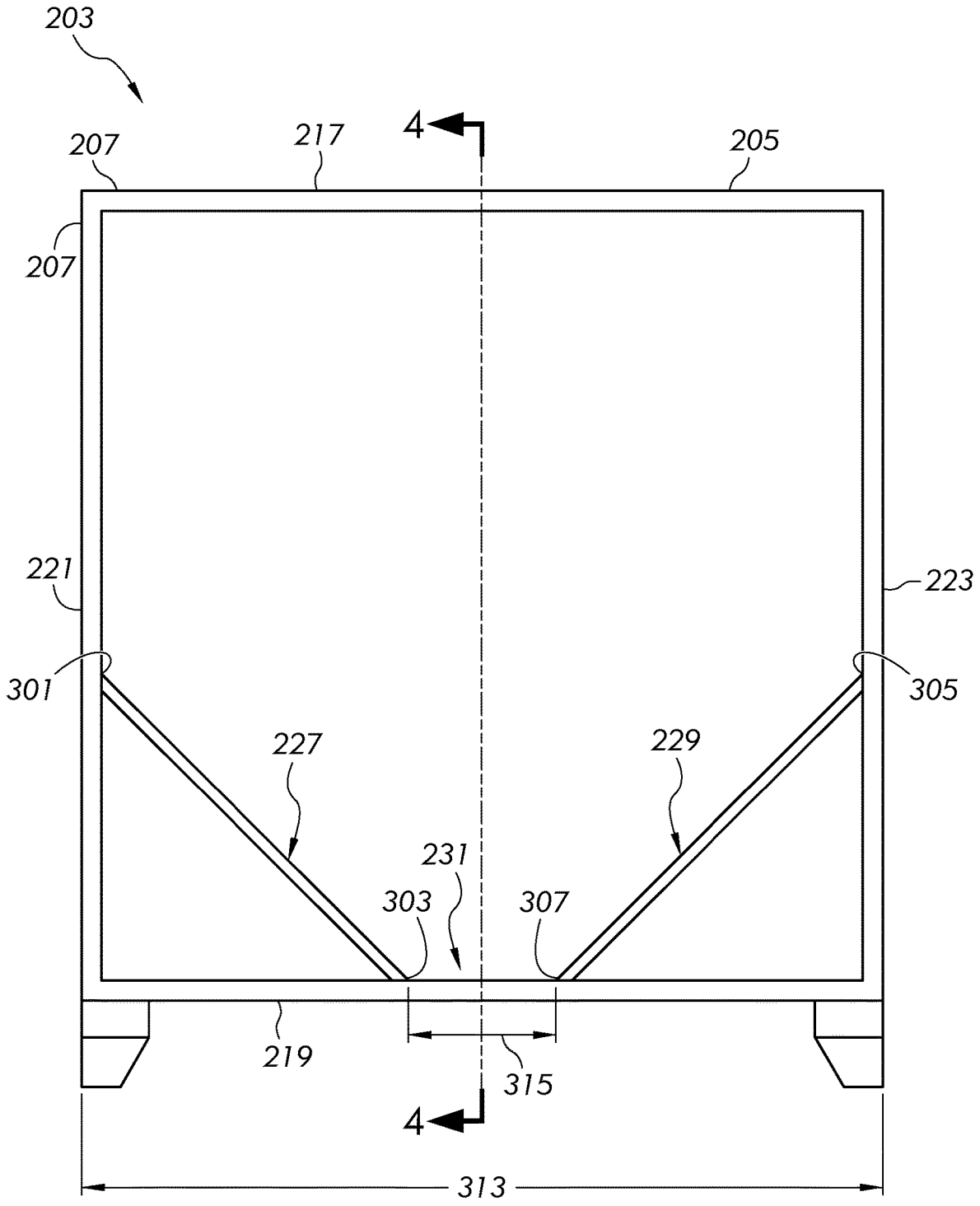
FIG. 3 illustrates an end view of the glass support apparatus in accordance with aspects of the disclosure.

FIG. 3 illustrates a side view of the glass support apparatus 203 without the spools of glass positioned within the interior space 209. In aspects, a first end 301 of the first surface 227 is attached to the third wall 221 and an opposing second end 303 of the first surface 227 is attached to the second wall 219. A first end 305 of the second surface 229 is attached to the fourth wall 223 and an opposing second end 307 of the second surface 229 is attached to the second wall 219. By converging in a direction away from the frame axis 215, a first distance 313 can separate the first ends 301, 305 and a second distance 315 can separate the second ends 303, 307, with the first distance 313 greater than the second distance 315. In this way, the surfaces 227, 229 can be tapered. In aspects, the first distance 313 can be substantially constant along the frame axis 215, for example, with the first distance 313 separating the first ends 301, 305 being substantially the same at all locations within the interior space 209. Likewise, in aspects, the second distance 315 can be substantially constant along the frame axis 215, for example, with the second distance 315 separating the second ends 303, 307 being substantially the same at all locations within the interior space 209.

Referring to FIGS. 2-3, the first spool of glass 201 and a second spool of glass 241 can be supported within the interior space 209 by the first surface 227 and the second surface 229. In aspects, the spools of glass 201 may comprise flanges. For example, the first spool of glass 201 may comprise first flanges 243, and the second spool of glass 241 may comprise second flanges 245. The flanges 243, 245 may be located at opposing ends of the spools of glass 201, 241, with the spooled glass located between the first flanges 243 and the second flanges 245. In aspects, the first flanges 243 may rest upon, in contact with, the surfaces 227, 229, and the second flanges 245 may rest upon, in contact with, the surfaces 227, 229. As such, the glass (e.g., positioned between the flanges 243 of the first spool of glass 201 and positioned between the flanges 245 of the second spool of glass 241) may be spaced apart, and not in contact with, the surfaces 227, 229. Due to the tapered orientation of the surfaces 227, 229, the frame 205 can support several sizes of spools of glass 201, 241. For example, the surfaces 227, 229 can support spools of glass 201, 241 comprising a range of diameters from small to large, with the differing sized spools of glass 201, 241 remaining in contact with, and resting upon, the surfaces 227, 229.

In aspects, the glass support apparatus 203 can comprise one or more engagement features that can facilitate stacking and/or attachment between multiple frames. For example, referring to FIG. 2, the first wall 217 can comprise a first engagement feature 251 and the second wall 219 can comprise a second engagement feature 253. In aspects, the first engagement feature 251 can comprise a plurality of recesses (e.g., openings, depressions, indentations, etc.) that may be positioned at the intersection of the first wall 217 and the third wall 221, and at the intersection of the first wall 217 and the fourth wall 223. The recesses may extend partially, but not completely, through the walls 217, 221, 223. In aspects, the second engagement feature 253 can comprise a plurality of protrusions (e.g., extensions, outcroppings, etc.) that may project outwardly from the second wall 219. In aspects, the plurality of protrusions may be positioned to substantially match a location and a number of the plurality of recesses. For example, a distance separating the plurality of protrusions may substantially match a distance separating the plurality of recesses. Similarly, the first engagement feature 251 can comprise four recesses and the second engagement feature 253 can comprise four protrusions. In aspects, the plurality of protrusions may comprise a size and shape that substantially matches a size and shape of the plurality of recesses. In this way, the first engagement features 251 can engage with second engagement features (e.g., substantially identical to the second engagement feature 253 in FIG. 2) of a second frame positioned above the frame 205, for example, with the second engagement features of the second frame configured to be received within the first engagement features 251 of the frame 205. In addition, or in the alternative, the second engagement features 253 can engage with first engagement features (e.g., substantially identical to the first engagement feature 251 in FIG. 2) of a third frame positioned below the frame 205, for example, with the second engagement features 253 of the frame 205 configured to be received within the first engagement features of the third frame.

Figure 4:
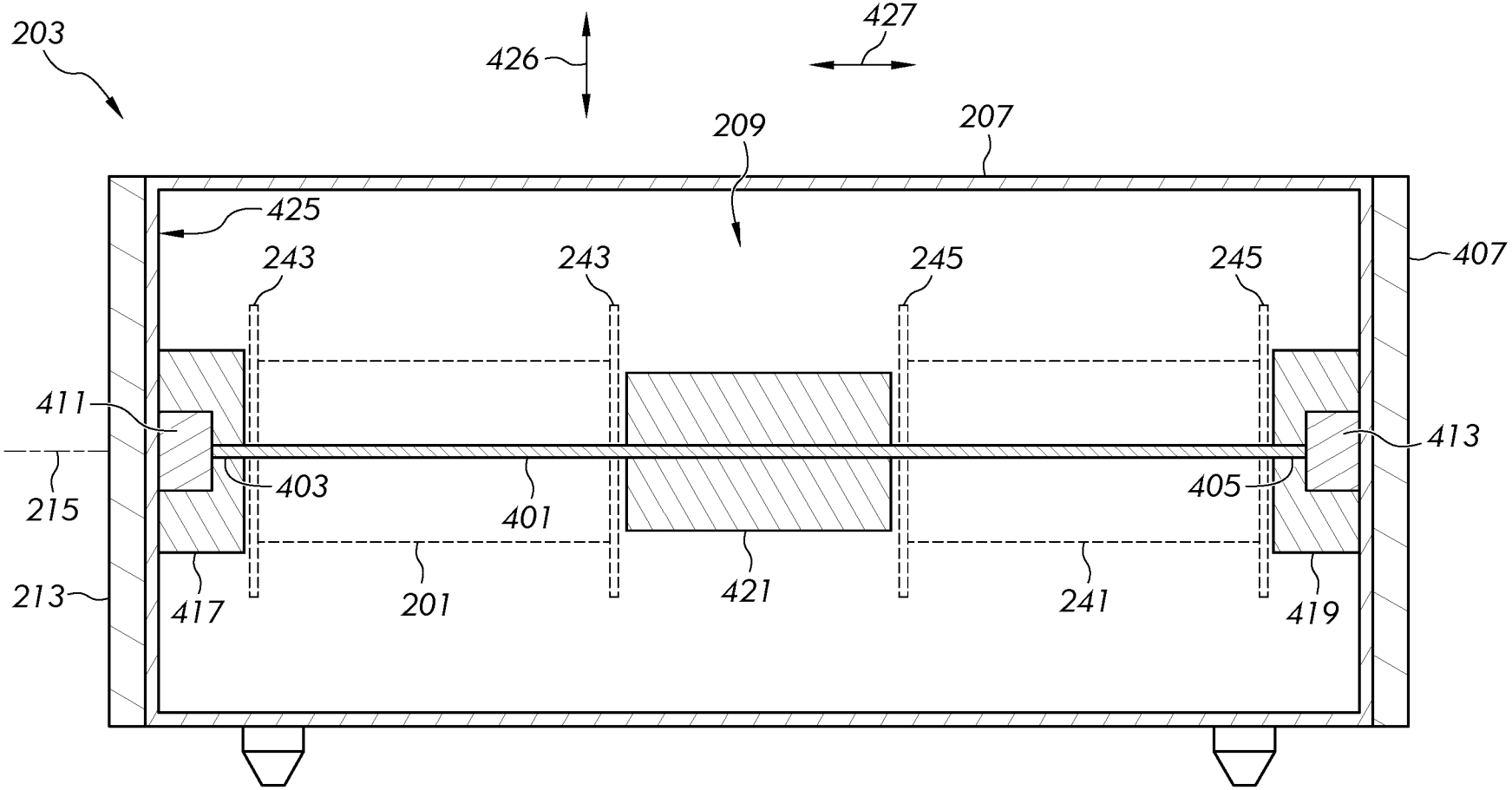
FIG. 4 illustrates a sectional view along lines 4-4 of FIG. 3 of the glass support apparatus in accordance with aspects of the disclosure.

FIG. 4 illustrates a cross-sectional view of the glass support apparatus 203 along lines 4-4 of FIG. 3 with the first spool of glass 201 and the second spool of glass 241 positioned within the interior space 209 with the closure 213 in the closed position. In aspects, the glass support apparatus 203 can comprise a shaft 401 positioned within the interior space 209 and extending substantially parallel to the frame axis 215, with the shaft 401 extending linearly between a first end 403 and an opposing second end 405. In aspects, the shaft 401 can be positioned to extend through a center (e.g., a center opening or channel) of the first spool of glass 201 and the second spool of glass 241, such that the shaft 401 extends coaxially through the spools of glass 201, 241. In aspects, the first end 403 of the shaft may be attached to the closure 213 and the opposing second end 405 may be attached to an end wall 407 of the plurality of walls 207 opposite the closure 213. The end wall 407 can extend substantially parallel to the closure 213 when the closure 213 is in the closed position, with the end wall 407 attached to the first wall 217, the second wall 219, the third wall 221, and the fourth wall 223.

The ends 403, 405 of the shaft 401 can be attached to the closure 213 and the end wall 407 in several ways. For example, the glass support apparatus 203 can comprise a first support structure 411 attached to the closure 213 and a second support structure 413 attached to the end wall 407. In aspects, the first support structure 411 can comprise an opening sized and shaped to receive the first end 403 of the shaft 401, and the second support structure 413 can comprise an opening sized and shaped to receive the second end 405 of the shaft 401. In aspects, the first support structure 411 and the second support structure 413 can be positioned such that, when the ends 403, 405 are received by the support structures 411, 413, the shaft 401 can extend substantially parallel to the frame axis 215. For example, the shaft 401 can extend substantially parallel to the first wall 217, the second wall 219, the third wall 221, and the fourth wall 223, and substantially perpendicular to the closure 213 and the end wall 407. In this way, when the closure 213 is in the closed position, the shaft 401 can extend through the spools of glass 201, 241 and may be supported by the support structures 411, 413. When the closure 213 is in the opened position, the shaft 401 can be detached from the support structures 411, 413 and removed from the centers of the spools of glass 201, 241.

The glass support apparatus 203 can comprise one or more spacers that can cushion the spools of glass 201, 241 and limit the likelihood of damage to the spools of glass 201, 241 when the glass support apparatus 203 is transported. In aspects, the glass support apparatus 203 can comprise a first spacer 417, a second spacer 419, and a third spacer 421. The first spacer 417 can be positioned between the closure 213 and the first spool of glass 201. For example, the first spacer 417 can be positioned within the interior space 209 in contact with an inner surface 425 of the closure 213 and the first flange 243 of the first spool of glass 201. The second spacer 419 can be positioned within the interior space 209 in contact with an inner surface of the end wall 407 and the second flange 245 of the second spool of glass 241. In aspects, the third spacer 421 can be positioned between the first spool of glass 201 and the second spool of glass 241. The spacers 417, 419, 421 can comprise an elastically deformable material (e.g., rubber, foam, etc.) that can temporarily deform in response to a load, followed by a reversion to an original shape. In aspects, the spacers 417, 419, 421 can comprise openings within which the shaft 401 can be received, such that the spacers 417, 419, 421 can be supported by the shaft 401.

Together, the shaft 401 and the spacers 417, 419, 421 can function to protect the spools of glass 201, 241 from damage and limit the spools of glass 201, 241 from moving within the frame 205. For example, the spools of glass 201, 241 can receive the shaft 401 through a center of the spools of glass 201, 241. In this way, the shaft 401 can limit movement of the spools of glass 201, 241 in a first direction 426 (e.g., perpendicular to the frame axis 215 and the shaft 401) and maintain the spools of glass 201, 241 in contact with the first surface 227 and the second surface 229. The spacers 417, 419, 421 can be positioned adjacent to ends of the spools of glass 201, 241. As such, the spacers 417, 419, 421 can limit movement of the spools of glass 201, 241 in a second direction 427 (e.g., parallel to the frame axis 215 and the shaft 401) and limit the spools of glass 201, 241 from contacting the closure 213 or the end wall 407. As such, the glass support apparatus 203 can be moved and transported, with the spools of glass 201, 241 protected within the interior space 209 and shielded from damage. Further, by limiting movement of the spools of glass 201, 241 within the interior space 209, the spools of glass 201, 241 may be maintained in a stationary and static position relative to the surfaces 227, 229, thus reducing the shedding of particles that may result from result from friction and movement. Reducing particle formation within the interior space 209 is beneficial to maintain a clean room environment within the interior space 209. In aspects, the shaft 401 may maintain the spools of glass 201, 241 spaced apart from and not in contact with the surfaces 227, 229, such that the spools of glass 201, 241 may be suspended within the interior space 209. In this way, the shaft 401 can limit the spools of glass 201, 241 from moving in the first direction 426 while the spacers 417, 419, 421 can limit the spools of glass 201, 241 from moving in the second direction 427. Accordingly, the shaft 401 can support the spools of glass 201, 241 in contact with or spaced apart from the surfaces 227, 229.

Figure 5:
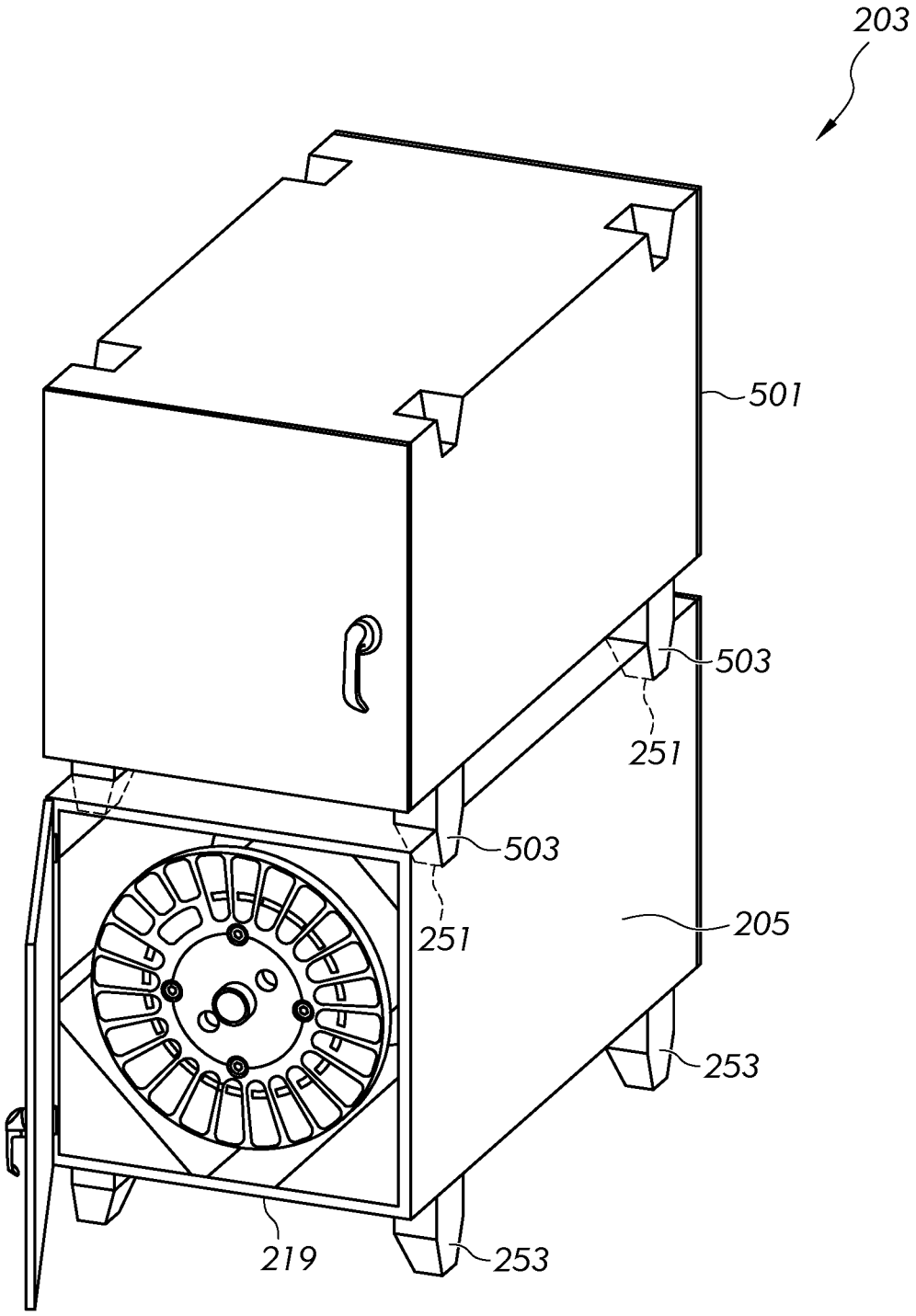
FIG. 5 illustrates a perspective view of a plurality of glass support apparatuses in accordance with aspects of the disclosure.

FIG. 5 illustrates the frame 205 and a second frame 501 in a vertically-stacked orientation. For example, during transportation and storage, it may be beneficial to vertically-stack multiple frames while restricting relative movement limited between the frames. The engagement features 251, 253 can function to maintain one frame (e.g., the second frame 501) in a fixed and static position relative to a second frame (e.g., the frame 205). In aspects, the second frame 501 can comprise an engagement feature 503 positioned at a bottom wall of the second frame 501. In aspects, the engagement feature 503 can comprise a protrusion and may be substantially similar to the second engagement feature 253 illustrated in FIG. 2. The engagement feature 503 can mate with the engagement feature 251 of the frame 205, for example, with the protrusions of the engagement feature 503 being received within the recesses of the engagement feature 251. In this way, the second frame 501 may be limited from moving relative to the frame 205, thus reducing the likelihood of inadvertent detachment or falling and, protecting the spools of glass.

Figure 6:
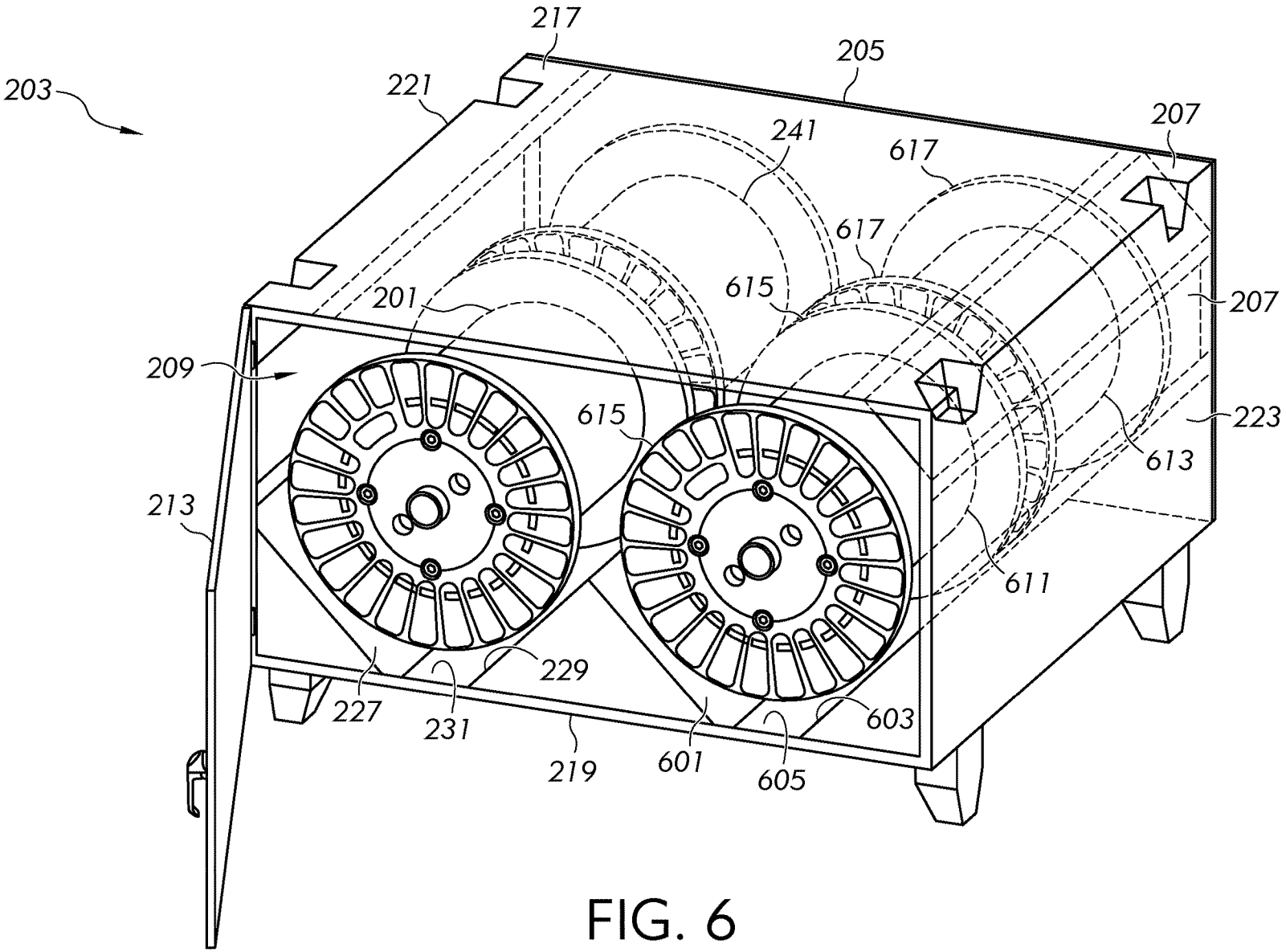
FIG. 6 illustrates a glass support apparatus supporting a plurality of spools of glass in accordance with aspects of the disclosure.

FIG. 6 illustrates additional aspects of the glass support apparatus 203, in which the glass support apparatus 203 can be sized to receive spools of glass in addition to the spools of glass 201, 241 illustrated in FIG. 2. The glass support apparatus 203 of FIG. 6 may comprise the frame 205, the plurality of walls 207, the closure 213, the first surface 227, and the second surface 229. In addition, the glass support apparatus 203 can comprise additional surfaces for supporting spools of glass, for example, a third surface 601 and a fourth surface 603. The third surface 601 can be substantially identical to the first surface 227. For example, the third surface 601 can be positioned within the interior space 209 and can extend parallel to the first surface 227, with the second surface 229 positioned between the first surface 227 and the third surface 601. In aspects, the fourth surface 603 can be substantially identical to the second surface 229. For example, the fourth surface 603 can be positioned within the interior space 209 and spaced apart from the third surface 601, with the fourth surface 603 extending parallel to the second surface 229 and the third surface 601 positioned between the second surface 229 and the fourth surface 603.

In aspects, the third surface 601 and the fourth surface 603 can be spaced apart, for example, with the third surface 601 and the fourth surface 603 non-parallel and converging in a direction away from the frame axis 215. In aspects, the third surface 601 and the fourth surface 603 may be substantially planar. The third surface 601 can extend between and be attached to the second surface 229 and the second wall 219. The fourth surface 603 can extend between and be attached to the fourth wall 223 and the second wall 219. In aspects, the third surface 601 can be positioned as a mirror image of the fourth surface 603, with a base surface 605 extending between the third surface 601 and the fourth surface 603. The second wall 219 can comprise the base surface 605, such that the third surface 601 may be spaced apart and not in contact with the fourth surface 603. In aspects, the width of the base surface 605 (e.g., distance between the third surface 601 and the fourth surface 603) may be substantially constant along the frame axis 215 between the closure 213 and the end wall 407.

The third surface 601 and the fourth surface 603 can be tapered such that a third spool of glass 611 and a fourth spool of glass 613 can be supported within the interior space 209 by the third surface 601 and the fourth surface 603. In aspects, the third spool of glass 611 can comprise third flanges 615 and the fourth spool of glass 613 can comprise fourth flanges 617. In aspects, the third flanges 615 and the fourth flanges 617 may rest upon, in contact with, the third and fourth surfaces 601, 603. Due to the tapered orientation of the surfaces 601, 603, the frame 205 can support several sizes of spools of glass 611, 613. For example, the surfaces 601, 603 can support spools of glass 611, 613 comprising a range of diameters from small to large, with the differing sized spools of glass 611, 613 remaining in contact with, and resting upon, the surfaces 601, 603. In aspects, an additional shaft (e.g., substantially identical to the shaft 401 illustrated in FIG. 4) and additional spacers (e.g., substantially identical to the spacers 417, 419, 421 illustrated in FIG. 4) can be provided to engage the spools of glass 611, 613 to both protect and limit the movement of the spools of glass 611, 613 in a substantially identical manner as illustrated and described relative to FIG. 4 (e.g., in the movement directions 426, 427).

In aspects, to further protect the spools of glass 201, 241, 611, 613, one or more walls can be provided within the interior space 209 to isolate each of the spools from the other spools. For example, a wall can be provided between the spools of glass 201, 241 supported on the first surface 227 and the second surface 229 and the spools of glass 611, 613 supported on the third surface 601 and the fourth surface 603. In aspects, the wall can extend vertically between the first wall 217 and the intersection of the second surface 229 and the third surface 601. In addition, or in the alternative, additional walls can be provided between the first spool of glass 201 and the second spool of glass 241, and between the third spool of glass 611 and the fourth spool of glass 613. In this way, in the event of one of the spools of glass 201, 241, 611, 613 being damaged, for example, during transportation, the damaged spool of glass may emit particles (e.g., glass particles) into the air. However, due to the presence of the walls, the emitted particles may be isolated and remain in the area surrounding the damaged spool of glass, such that the emitted particles may be limited from contaminating the undamaged spools of glass (e.g., due to the walls blocking the emitted particles).

Figure 7:
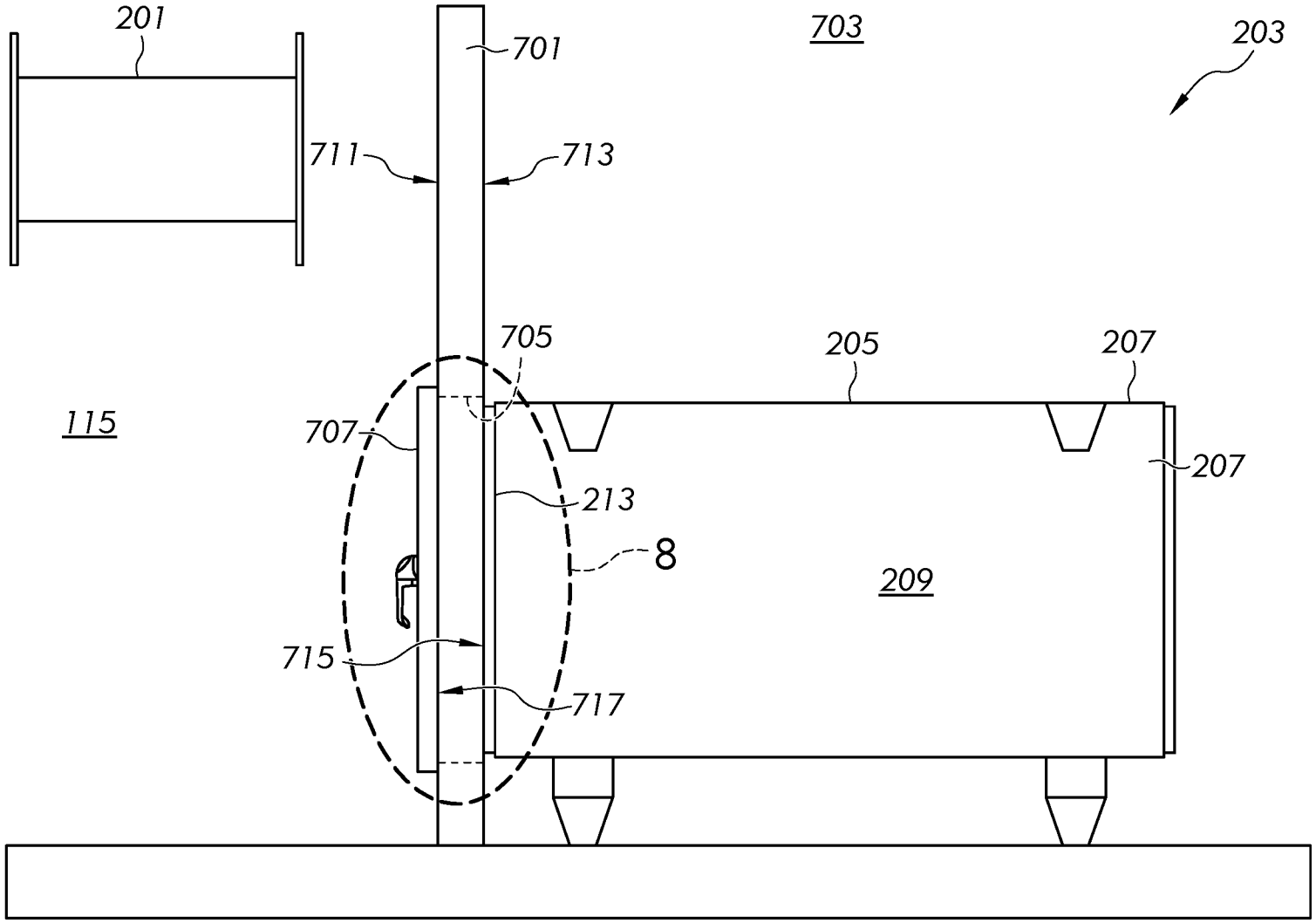
FIG. 7 illustrates a side view of the glass support apparatus in accordance with aspects of the disclosure.

FIGS. 7-10 illustrate the process of loading of one or more spools of glass into the glass support apparatus 203. For example, FIG. 7 illustrates a side view of the glass support apparatus 203 engaging with a wall 701 of the clean room environment 115. The wall 701 can separate the clean room environment 115 from an exterior environment 703 that is not maintained to the same concentration of airborne particulates. The wall 701 can comprise an opening 705 defining a passageway between the clean room environment 115 and the exterior environment 703. In aspects, a door 707 can cover the opening 705 and is movable between an opened position, in which the opening 705 is uncovered and objects can pass through the opening 705 between the clean room environment 115 and the exterior environment 703, and a closed position, in which the opening 705 is blocked. FIG. 7 illustrates the door 707 in the closed position.

In aspects, the first spool of glass 201 (e.g., and the other spools of glass 241, 611, 613) may initially be stored in the clean room environment 115 to reduce the exposure of the spools of glass 201, 241, 611, 613 to airborne particulates. To load the glass support apparatus 203, the frame 205 can be positioned against the wall 701. For example, the wall 701 can comprise an inner surface 711, which faces and lies within the clean room environment 115, and an outer surface 713, which faces and lies within the exterior environment 703. The frame 205 may be located within the exterior environment 703 and can be positioned adjacent the outer surface 713 and the opening 705.

Figure 8:
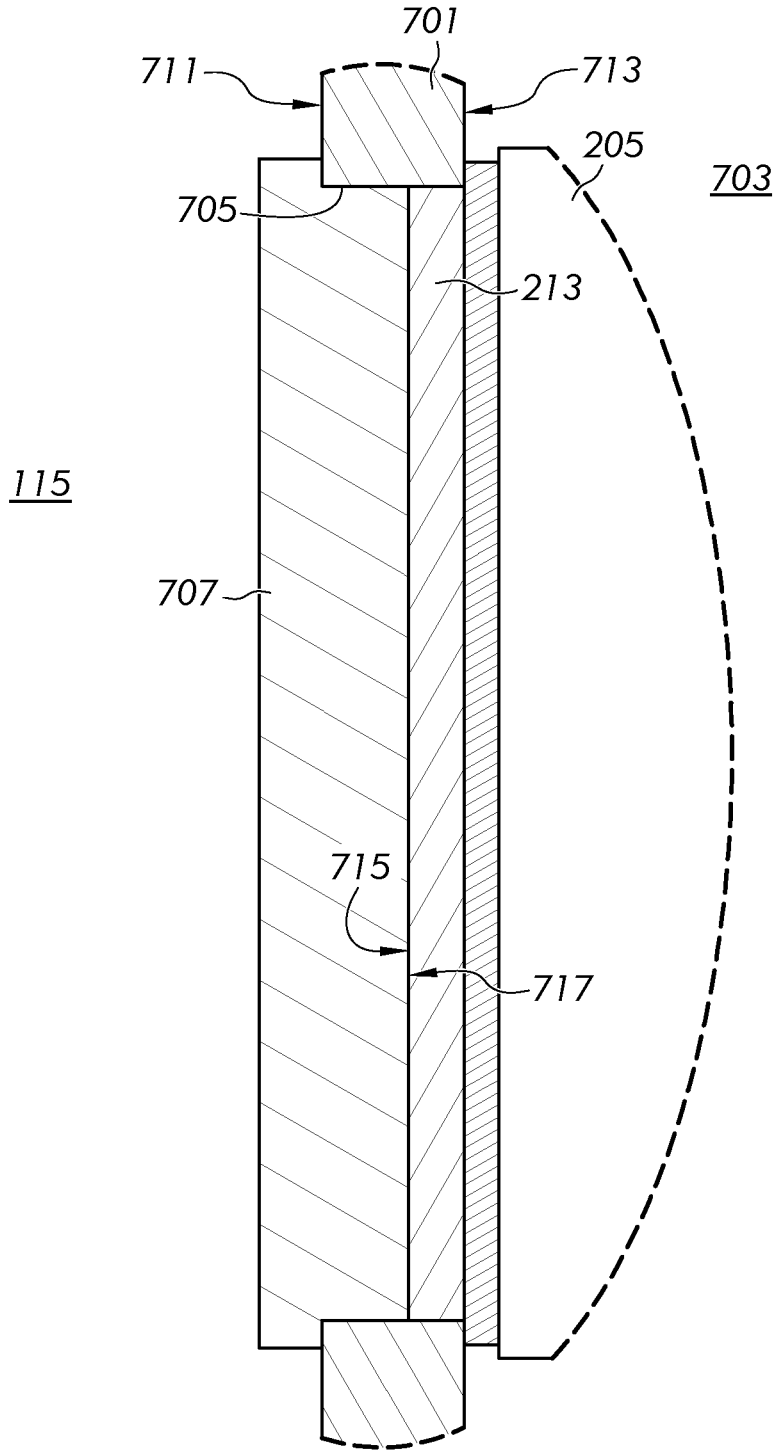
FIG. 8 illustrates a side view of focus circle 8 in FIG. 7 of the glass support apparatus in accordance with aspects of the disclosure.

FIG. 8 illustrates the wall 701, the opening 705, the door 707, and the glass support apparatus 203 as viewed from focus circle 8 of FIG. 7. The door 707 can cover the opening 705 and may form a seal with the inner surface 711 of the wall 701. In this way, the door 707 can limit the passage of air and particulates through the opening 705, thus maintaining the clean room environment 115. While FIG. 8 illustrates the door 707 as projecting at least partially into the opening 707, the door 707 is not so limited, and, in aspects, the door 707 may not project into the opening 705 but, rather, may cover the opening 705 and form the seal with the inner surface 711. To deliver one or more spools of glass 201, 241, 611, 613 to the glass support apparatus 203 from the clean room environment 115, the frame 205 may be brought into contact with the outer surface 713 of the wall 701. For example, the frame 205, and one or more of the plurality of walls 207 can contact the outer surface 713 to form an airtight seal. The frame 205 can form the seal with the outer surface 713 in several ways. For example, one or more magnets can be provided between the frame 205 and the outer surface 713 to form the airtight seal and maintain the frame 205 in contact with the outer surface 713. In addition, or in the alternative, in aspects, an elastomeric material, such as, for example, a foam gasket, can be positioned between the frame 205 and the outer surface 713 to provide the airtight seal. The airtight seal can be formed surrounding the opening 705 such that air and particulates are limited from traveling from the exterior environment, through the airtight seal (e.g., between the frame 205 and the outer surface 713) and into the opening 705.

In aspects, in addition to the seal between the frame 205 and the outer surface 713, the closure 213 can be attached to and sealed with the door 707. For example, the closure 213 can comprise a closure surface 715 facing the door 707, and the door 707 can comprise a door surface 717 facing the closure 213. The closure surface 715 can define an outer surface of the door 707 at an exterior of the glass support apparatus 203. In aspects, the closure surface 715 can be brought into contact with the door surface 717, such that a seal can be formed between the closure surface 715 and the door surface 717. The seal can be formed in several ways. For example, one or more magnets can be provided between the closure surface 715 and the door surface 717 to form the airtight seal and maintain the closure 213 in contact with the door 707. In addition, or in the alternative, in aspects, an elastomeric material, such as, for example, a foam gasket, can be positioned between the closure 213 and the door 707 to provide the airtight seal.

Figure 9:
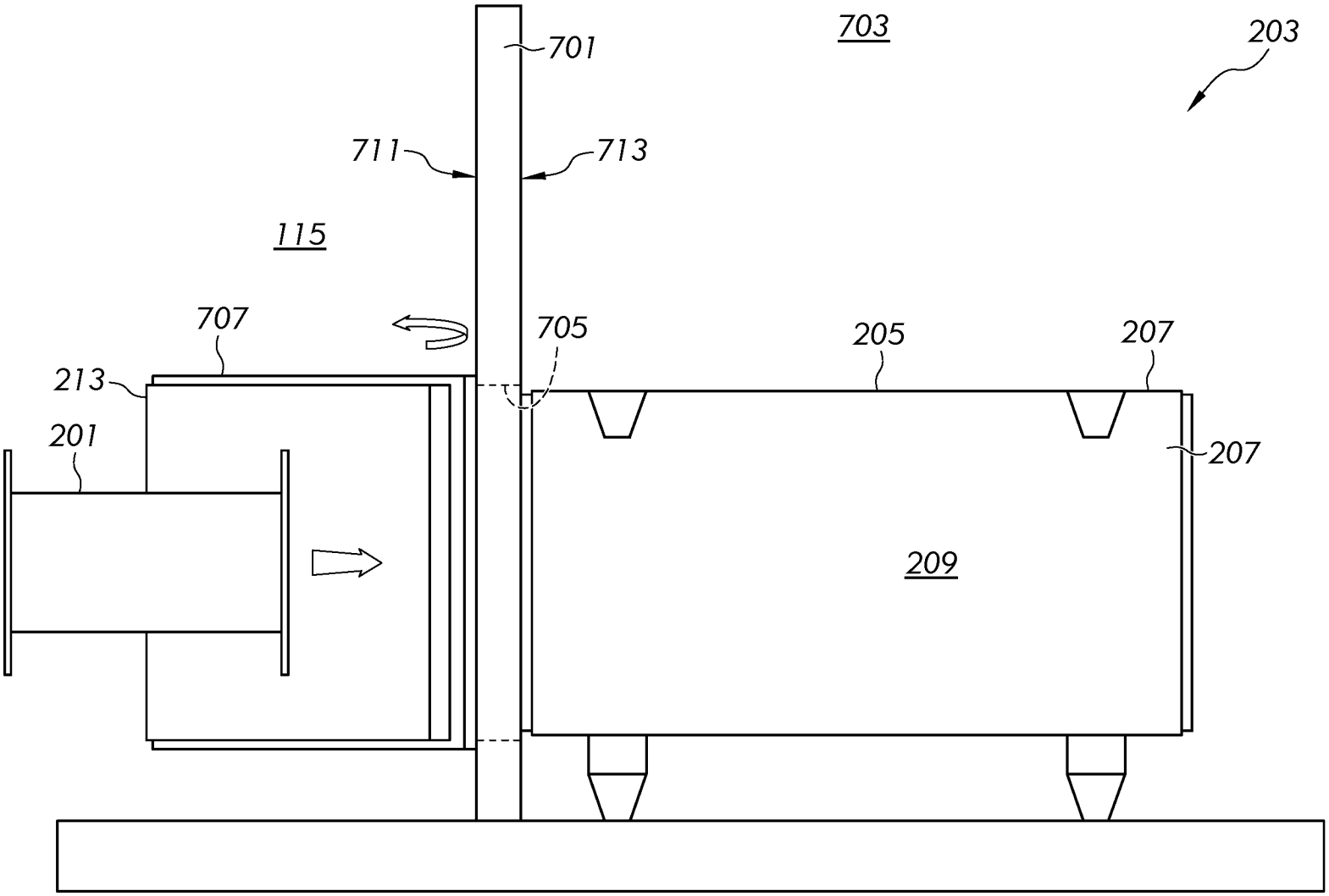
FIG. 9 illustrates a side view of the glass support apparatus with the closure in an opened position in accordance with aspects of the disclosure.

Referring to FIG. 9, once the seal is formed between the frame 205 and the wall 701 and between the closure 213 and the door 707, the closure 213 and the door 707 can be opened. For example, in aspects, the door 707 can be hinged and, similar to the closure 213, can pivot from the closed position (e.g., illustrated in FIGS. 7-8) to the opened position (e.g., illustrated in FIG. 9). In this way, the closure 213 and the door 707 can move to the opened position unitarily as a single structure (e.g., moving together). As the closure 213 and the door 707 are opened, the seals (e.g., between the frame 205 and the wall 701 and between the closure 213 and the door 707) may remain intact, such that the clean room environment 115 is not exposed to the exterior environment 703. Methods of supporting a spool of glass can comprise exposing the spool of glass 201 to the clean room environment 115 prior to positioning the frame 205 against the wall 701 (e.g., illustrated in FIG. 7) and as the spool of glass 201 is delivered through the opening 705. For example, with the closure 213 and the door 707 in the opened position, the spool of glass 201 may remain exposed to the clean room environment 115 since the exterior environment 703 is sealed. In aspects, methods of supporting a spool of glass can comprise positioning the frame 205 comprising the interior space 209 against the wall 701 comprising the opening 705 such that the interior space 209 may be in fluid communication with the opening 705 and the frame 205 forms a seal with the wall 701. As used herein, fluid communication can comprise a gas-flow path between two or more cavities, for example, the interior space 209, the opening 705, and the clean room environment 115.

In aspects, methods can comprise delivering the spool of glass 201 from the clean room environment 115 through the opening 705 and into the interior space 209 of the frame 205. For example, with the closure 213 and the door 707 open, the frame 205 is positioned to receive the first spool of glass 201. In aspects, an operator can move the first spool of glass 201 through the opening 705 and into the interior space 209, whereupon the first spool of glass 201 can be supported by the surfaces 227, 229 (e.g., illustrated in FIG. 2). In aspects, one or more of the additional spools of glass 241, 611, 613 can similarly be passed from the clean room environment 115 through the opening 705 and into the interior space 209, whereupon the one or more additional spools of glass 241, 611, 613 can be supported by the surfaces 227, 229, 601, 603 (e.g., as illustrated in FIGS. 2-6). During the loading of the spools of glass 201, 241, 611, 613 into the interior space 209, the spools of glass 201, 241, 611, 613 may remain exposed to the clean room environment 115 and not the exterior environment 703 (e.g., due to the airtight seals), thus protecting the spools of glass 201, 241, 611, 613 from airborne particulates. In aspects, as the one or more spools of glass 201, 241, 611, 613 are positioned within the interior space 209, the shaft 401 and the spacers 417, 419, 421 may be moved into the interior space 209 and positioned similar to the illustration of FIG. 4. In this way, methods can comprise positioning the one or more spacers 417, 419, 421 at ends of the spools of glass 201, 241, 611, 613, with the one or more spacers 417, 419, 421 comprising an elastically deformable material.

Figure 10:
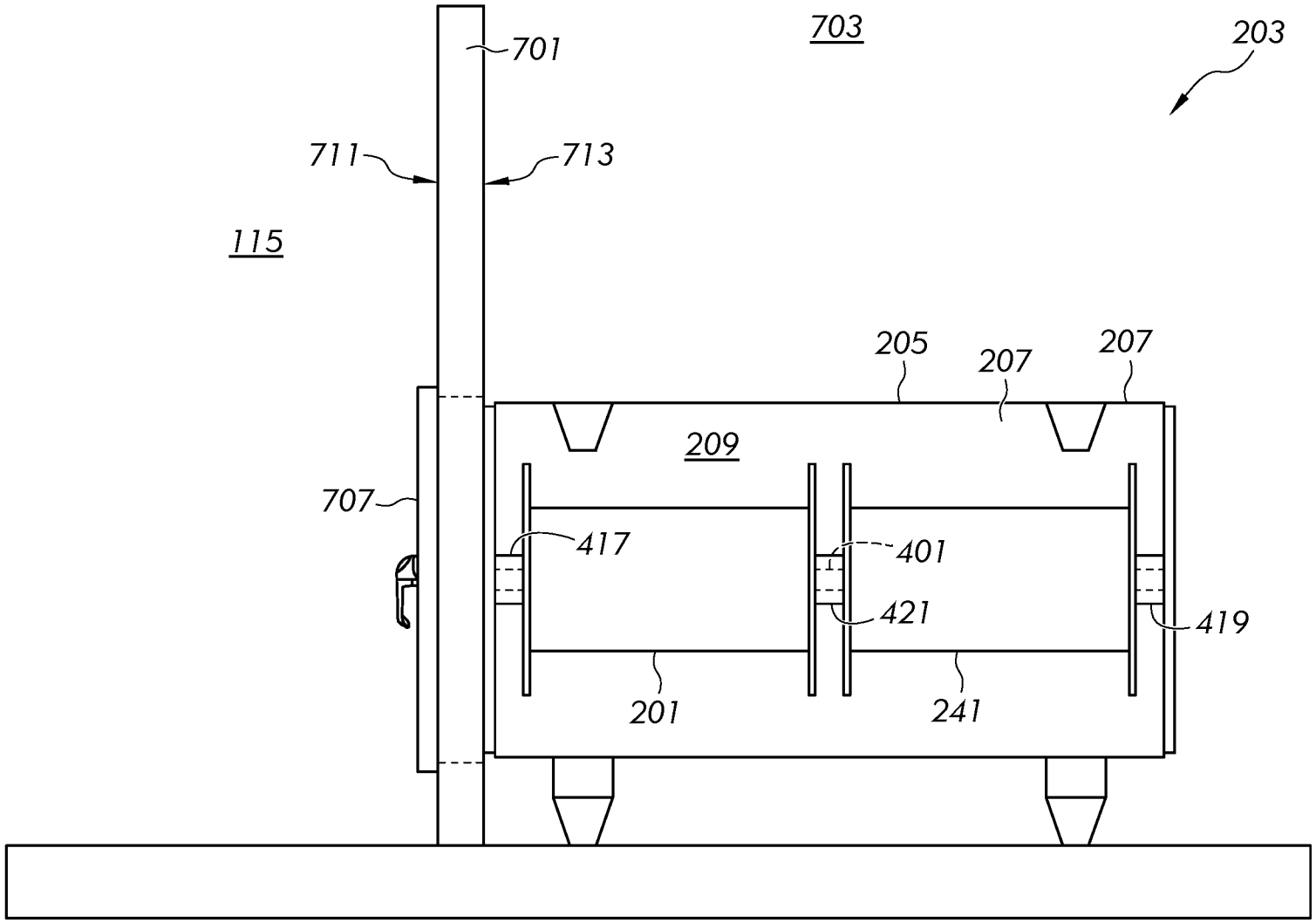
FIG. 10 illustrates a side view of the glass support apparatus with the closure in a closed position in accordance with aspects of the disclosure.

Referring to FIG. 10, once the one or more spools of glass 201, 241, 611, 613, the shaft 401, and the spacers 417, 419, 421 are positioned within the interior space 209, methods can comprise sealing the interior space 209 using the closure 213, for example, by closing the closure 213 onto the frame 205 to seal the interior space 209. For example, the closure 213 and the door 707 can be moved from the opened position (e.g., illustrated in FIG. 9) to the closed position of FIGS. 7, 8, and 10. In the closed position, the closure 213 can seal with the plurality of walls 207, thus forming the airtight seal and limiting the passage of air or particulates into the interior space 209. In aspects, with the closure 213 in the closed position and the door 707 closed and sealed with the wall 701, the frame 205 can be detached and separated from the wall 701. For example, the airtight seal between the outer surface 713 and the frame 205 may be broken and the frame 205 may be detached from the wall 701. Likewise, the airtight seal between the closure surface 715 of the closure 213 and the door surface 717 of the door 707 may be broken, and the closure 213 may be detached from the door 707. In this way, the glass support apparatus 203 can be removed from the wall 701 and transported to a different location.

During transportation, the spools of glass 201, 241, 611, 613 can remain in a substantially fixed position within the interior space 209, thus reducing the likelihood of damage to the spools of glass 201, 241, 611, 613 while being transported. In addition, during the process of loading the spools of glass 201, 241, 611, 613 into the interior space 209, the spools of glass 201, 241, 611, 613 are exposed to the clean room environment 115 and may not be exposed to the exterior environment 703. Similarly, the interior space 209 may be maintained at an atmosphere similar to the clean room environment 115, with the interior space 209 sealed by the closure 213. As such, the spools of glass 201, 241, 611, 613 may remain free from exposure to airborne particulates during transportation. In aspects, upon arriving at a destination, the spools of glass 201, 241, 611, 613 can be removed from the frame 205 by following the description illustrated in FIGS. 7-9. For example, with the spools of glass 201, 241, 611, 613 positioned within the interior space 209, the frame 205 and the closure 213 can be moved into contact with a wall and door (e.g., substantially identical to the wall 701 and the door 707 illustrated in FIGS. 7-10). The closure 213 can form an airtight seal with the door, and the frame 205 can form an airtight seal with the wall. Next, the closure 213 and the door can be moved from the closed position to the opened position, thus allowing for the spools of glass 201, 241, 611, 613 to be removed from the interior space 209 and passed through an opening into a clean room environment.

As described herein, the glass support apparatus 203 can store and protect one or more spools of glass. Further, the glass support apparatus 203 can maintain a clean room environment within the interior space 209 of the glass support apparatus 203, such that, as the spools of glass are protected from mechanical damage (e.g., due to vibration, shaking, etc.), the spools of glass may also be protected from airborne particulates that may be present in a non-clean room environment. For example, the glass support apparatus 203 can interact with a clean room environment while maintaining a clean room environment within the interior space 209 due to the closure sealing with the frame. The glass support apparatus 203 can be reused multiple times, thus reducing waste associated with a one-time-use container. The glass support apparatus 203 can likewise support a plurality of spools of glass (e.g., one or more) and, in aspects, may support varying sized spools due to the tapered surfaces. In aspects, the glass support apparatus 203 can be vertically stackable, thus allowing multiple glass support apparatuses to be stored in a more efficient manner, with a reduced likelihood of inadvertent detachment during storage. Further, the glass support apparatus 203 can allow for isolation of individual spools of glass positioned within the interior space 209. For example, the glass support apparatus 203 can comprise walls that separate and isolate the spools of glass. In this way, undamaged spools of glass can be protected from damaged spools of glass in the unlikely event of damage to a spool of glass during transportation. In aspects, the process of loading the spools of glass into the glass support apparatus 203 can be relatively quick, for example, taking less than about 10 minutes to complete, with the glass support apparatus 203 not required to be cleaned after each use.

It should be understood that while various aspects have been described in detail relative to certain illustrative and specific examples thereof, the present disclosure should not be considered limited to such, as numerous modifications and combinations of the disclosed features are possible without departing from the scope of the following claims.

What is claimed is:

1. A method of supporting a spool of glass comprising a first circular flange mounted to a central spool, a second circular flange mounted to the central spool, and a glass ribbon wound into a coil of glass ribbon on the central spool between the first circular flange and the second circular flange, wherein an outer diameter of an outer circumferential edge of the first circular flange is substantially equal to an outer diameter of an outer circumferential edge of the second circular flange and greater than an outer diameter of the coil of glass ribbon, and wherein the first circular flange, the second circular flange, the central spool, and the coil of glass ribbon are coaxially aligned along a central axis of the spool of glass, the method comprising:

inserting the spool of glass through a lateral opening of an interior space of a glass support apparatus while the glass support apparatus is in an open orientation;

supporting a weight of the spool of glass within the interior space of the glass support apparatus by contacting the glass support apparatus at a first location of the outer circumferential edge of the first circular flange and a second location of the outer circumferential edge of the first circular flange circumferentially spaced from the first location, and contacting the glass support apparatus at a first location of the outer circumferential edge of the second circular flange and a second location of the outer circumferential edge of the second circular flange circumferentially spaced from the first location of the second circular flange; and changing an orientation of the glass support apparatus from the open orientation to a closed orientation by covering the lateral opening with a closure of the glass support apparatus to seal the spool of glass ribbon within the interior space of the glass support apparatus.

2. The method of claim 1, further comprising:

sealing a frame of the glass support apparatus with a wall positioned between a clean room environment and an exterior environment, the wall comprising a wall opening and a wall closure covering the wall opening that seals the clean room environment from the exterior environment while the wall is in a closed orientation;

changing an orientation of the wall from the closed orientation to an open orientation by moving the wall closure to uncover the wall opening, and changing the orientation of the glass support apparatus from the closed orientation to the open orientation by moving the closure of the glass support apparatus to uncover the lateral opening of the glass support apparatus, wherein the interior space of the glass support apparatus is in fluid communication with the clean room environment while the frame remains sealed with the wall;

inserting the spool of glass through the lateral opening of the glass support apparatus to deliver the spool of glass from the clean room environment through the lateral opening and into the interior space of the of the glass support apparatus;

changing the orientation of the wall from the open orientation to the closed orientation while the glass support apparatus supports the spool of glass within the interior space of the glass support apparatus by covering the wall opening with the wall closure to seal the clean room environment from the exterior environment; and changing the orientation of the glass support apparatus from the open orientation to the closed orientation by moving the closure of the glass support apparatus to cover the lateral opening of the glass support apparatus with the spool of glass positioned within the interior space of the glass support apparatus.

3. The method of claim 2, wherein changing the orientation of the wall from the closed orientation to an open orientation and changing the orientation of the glass support apparatus from the closed orientation to the open orientation occur simultaneously.

4. The method of claim 3, further comprising attaching the closure of the glass support apparatus to the wall closure while the frame of the glass support apparatus is sealed with the wall, wherein the wall closure and the closure of the glass support apparatus move together to simultaneously change the orientation of the wall and the glass support apparatus from the closed orientation to the open orientation.

5. The method of claim 4, wherein attaching the closure of the glass support apparatus to the wall closure comprises magnetically attaching the closure of the glass support apparatus to the wall closure.

6. The method of claim 1, wherein the spool of glass comprises a first spool of glass and a second spool of glass.

7. The method of claim 6, wherein the first spool of glass and the second spool of glass are arranged in an end-to-end configuration with the central axis of the first spool of glass being coincident with the central axis of the second spool of glass.

8. The method of claim 7, wherein, after supporting the weight of the spool of glass, further comprising positioning a shaft within the interior space and through a center of the first spool of glass and a center of the second spool of glass to limit movement of the first spool of glass and the second spool of glass while the weight of the first spool of glass and the weight of the second spool of glass are supported by the glass support apparatus.

9. The method of claim 1, further comprising positioning one or more spacers at ends of the spool of glass, the one or more spacers comprising an elastically deformable material.

10. The method of claim 1, wherein, after supporting the weight of the spool of glass, further comprising positioning a shaft within the interior space and through a center of the spool of glass to limit movement of the spool of glass while the weight of the spool of glass is supported by the glass support apparatus.

11. The method of claim 10, further comprising supporting a first end of the shaft with the closure of the glass support apparatus and supporting a second end of the shaft, opposed to the first end of the shaft, with an end wall of the glass support apparatus opposite the closure of the glass support apparatus.

12. The method of claim 1, wherein supporting the weight of the spool of glass comprises contacting a first surface of the support apparatus at the first location of the outer circumferential edge of the first circular flange, and contacting a second surface of the support apparatus at the second location of the outer circumferential edge of the first circular flange.

13. The method of claim 12, wherein the first surface and the second surface converge in a downward direction from the central axis of the spool of glass.

14. The method of claim 12, wherein supporting the weight of the spool of glass further comprises contacting the first surface of the support apparatus at the first location of the outer circumferential edge of the second circular flange, and contacting the second surface of the support apparatus at the second location of the outer circumferential edge of the second circular flange.

15. The method of claim 14, wherein the first surface and the second surface converge in a downward direction from the central axis of the spool of glass.

* * * * *